United States Patent [19]

Blom et al.

[11] 3,942,633

[45] Mar. 9, 1976

[54] PROTECTIVE MATCH BOOK HOLDER

[76] Inventors: Gerald E. Blom, 8020 Portland Ave. South, Bloomington, Minn. 55420; Robert W. Van Leuven, 12153 Geneva Way, Apple Valley, Minn. 55124

[22] Filed: Apr. 21, 1975

[21] Appl. No.: 569,864

[52] U.S. Cl. ..... 206/107; 206/108

[51] Int. Cl.[2] ..... A24F 27/04

[58] Field of Search ..... 206/108, 118, 107

[56] References Cited

UNITED STATES PATENTS

| | | | |
|---|---|---|---|
| 749,539 | 1/1904 | Dodge | 206/118 |
| 1,580,934 | 4/1926 | Traute | 206/107 |
| 2,337,305 | 12/1943 | Arenson | 206/107 |
| 3,690,449 | 9/1972 | Seldin | 206/108 |

*Primary Examiner*—Leonard Summer

[57] ABSTRACT

A holder for a book of matches comprised of an enclosure element having a back panel and top and bottom retention lips which partially enclose the match book. First and second side panels restrict lateral movement of the match book to prevent removal of the book by children. The match book strike plate is accessible only through an opening in the back panel of the enclosure which is covered by a movable guard element. The guard element is biased in a closed position by means of a spring mechanism and release tab to prevent access to the strike plate by children.

5 Claims, 10 Drawing Figures

FIG. 1
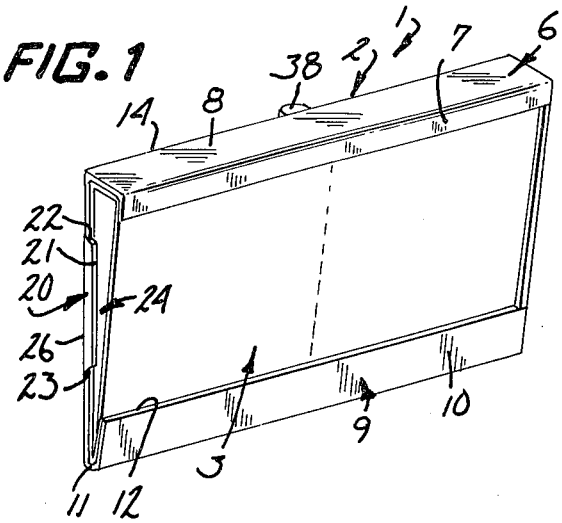
FIG. 2
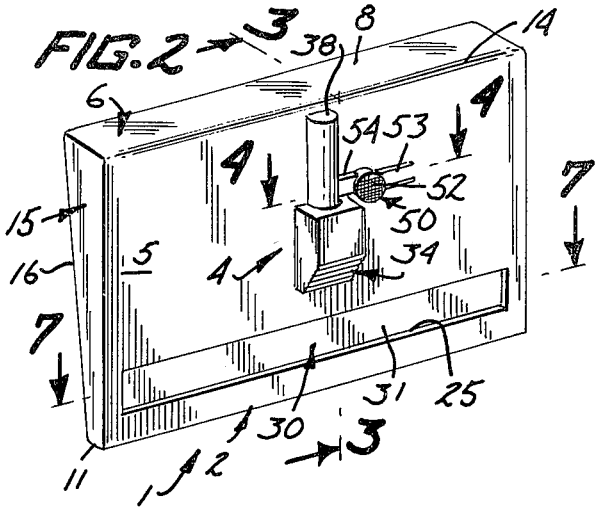
FIG. 9
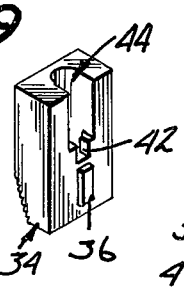
FIG. 4
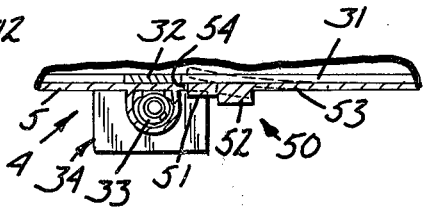
FIG. 3
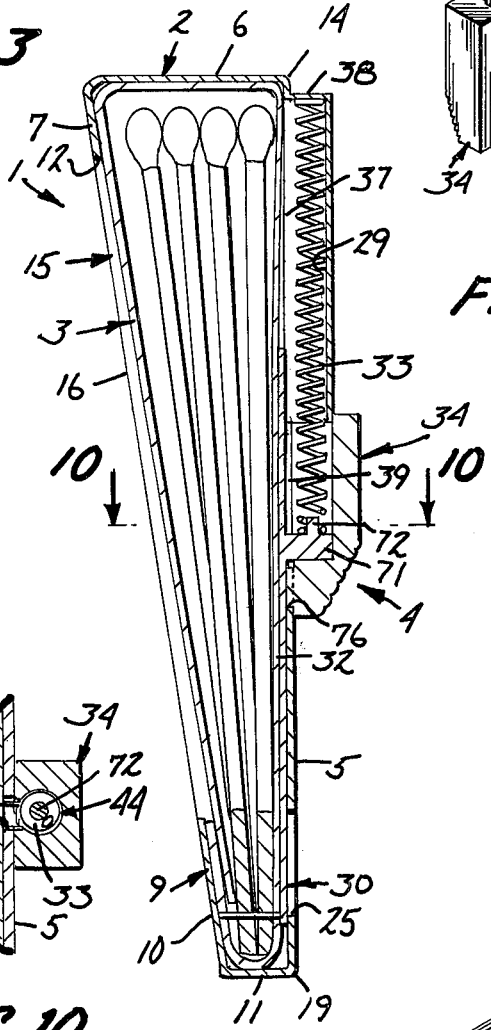
FIG. 6
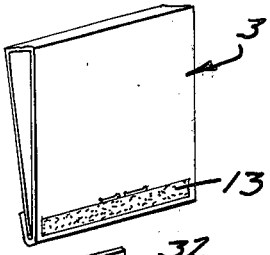
FIG. 5
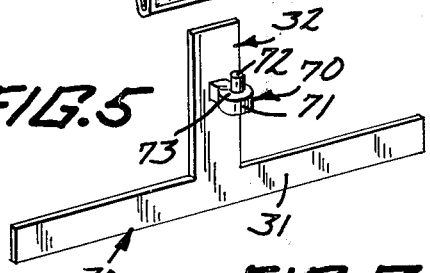
FIG. 10
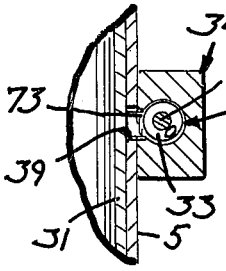
FIG. 7
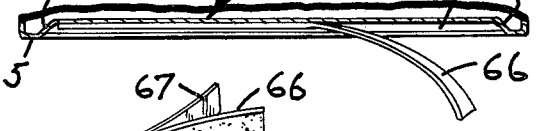
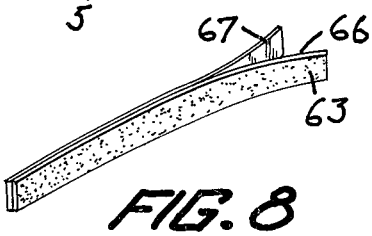
FIG. 8

PROTECTIVE MATCH BOOK HOLDER

BACKGROUND OF THE INVENTION

1. Field of the Invention

A special receptacle for combtype match books having ignition and removal-prevention devices.

2. Description of the Prior Art

Flexible matches which can be ignited by striking the match on a roughened surface are available in several forms. A very popular form is the relatively inexpensive comb-type booklet wherein a plurality of matches are arranged in a side-by-side array and are enclosed by a flexible match book cover which is frequently imprinted with advertising matter and the like. A strike plate is generally provided at some location on the match book cover or back panel for use in igniting the matches after they are removed from the book.

Because match books are generally constructed of flexible material such as paper, several match book holders are presently available which are primarily intended to be protective devices for holding the match book and keeping them dry for easy lighting. These devices frequently include an enclosure element, a hinged cover and an unrestricted opening which exposes the match book strike plate. One particular device (U.S. Pat. No. 2,341,856) provides a guard member for covering the strike plate opening. Such devices are generally not intended to prevent removal of the match book from the holder or striking of the match book by children.

Many of the presently available match book holders are limited in their usefulness by several factors. Because some of these holders totally enclose the match book, the advertising and other printed matter on the match book cover cannot be displayed. In other instances, the match book can be easily removed from the holder which makes it possible for a child to remove the match book from the holder and ignite the matches. Further, the strike plate of the match book is generally exposed, allowing the striking of matches by children. Where a guard element is provided for covering the strike plate, it is generally of such a simple design that it could be easily manipulated and opened by a child playing with the match book holder.

Because the relatively inexpensive paper match books are generously dispensed to the public to promote the advertising material which they carry, the match books are frequently available to children where they cause damaging fires and injury. As a result, various restrictions on the design of match books have been proposed, including proposed regulations under the Occupational Safety and Health Act (OSHA). In certain forms, such regulations may actually prevent the dispensing and use of the paper match book unless suitable packaging of the match book can be provided which reduces the likelihood of misuse of the match book by children.

SUMMARY

The present invention is a holder for flexible, comb-type match books which is intended to prevent or reduce the likelihood of misuse of the match book by children. The match book holder is comprised of an enclosure element which is comprised of a back panel and top and bottom retention lips. The retention lips partially surround the top and bottom edges of the match book, leaving the advertising material which is typically carried on the front cover of a match book exposed.

A solid side panel attached to one side of the back panel covers one end of the enclosure. This prevents the match book from sliding out of the match book holder. A second side panel attached to the opposite end of the enclosure back panel partially covers the second end of the enclosure. This partial covering of one end of the enclosure allows a full book of matches to be forcibly inserted past the partial side panel into the enclosure, but makes it very difficult to remove the full or partially full match book. When all of the matches have been removed from the match book, the match book is very flexible and can then be easily removed from the enclosure.

An opening in the back panel of the enclosure exposes a strike plate which is carried on the back side of the match book. In an alternative embodiment, a permanent strike plate is attached adjacent the back panel of the match book enclosure. A guard plate is slidably attached to the enclosure back panel and moves from an open position in which the strike plate is exposed through the strike plate opening to a closed position wherein the opening is covered. A coil spring attached to the guard plate and to the enclosure back panel forcibly biases the guard plate to its closed position. A grip element attached to the guard plate allows the guard plate to be moved against the biasing spring force by finger movement by an adult. It is very difficult for a child to overcome the biasing force to move the guard plate. This helps prevent striking of a match by a child or mentally deficient person who may come into contact with the match book holder. Further, a release tab on the enclosure back panel prevents movement of the grip element except when the release tab is depressed by thumb or finger action.

BRIEF DESCRIPTION OF THE DRAWINGS

FIG. 1 is a front perspective view of the match book holder with a book of matches inserted;

FIG. 2 is a back perspective view of the match book holder of FIG. 1 showing the strike plate opening and shielding means;

FIG. 3 is an end view in section of the match book holder shown in FIG. 2 taken along the line 3—3;

FIG. 4 is a top detailed view of the match book holder shown in FIG. 2 taken along the line 4—4;

FIG. 5 is a detailed perspective view of the strike plate cover element;

FIG. 6 is a perspective view of a comb-type match book which could be retained in the match book holder;

FIG. 7 is a detailed top sectional view of an alternative match book holder design showing a removable strike element;

FIG. 8 is a detailed perspective view of the removable strike element of FIG. 7 showing the adhesive backing strip;

FIG. 9 is a detailed perspective view of the grip element; and

FIG. 10 is a detailed axial cross-sectional view taken along the line 10—10 in FIG. 3.

DESCRIPTION OF THE PREFERRED EMBODIMENTS

Referring to FIGS. 1–10 wherein like numerals refer to like structural elements, the match book holder 1 can generally be described as comprising an enclosure 2 into which can be inserted a match book 3 and which utilizes a shielding apparatus 4 to cover the strike plate, thereby preventing children from striking the matches on the strike plate.

As is shown in detail in FIGS. 1–3, enclosure 2 is comprised of a back panel 5 to which is attached a top retaining lip 6 and a bottom retaining lip 9. Top retaining lip 6 is constructed of a generally flat rectangular top element 8 which is attached to the top edge 14 of back panel 5. In the preferred embodiment, top element 8 is generaly perpendicular to back panel 5. A front element 7 is attached to the front edge of top element 8 and extends downwardly and inwardly toward back panel 5. It is the purpose of top retaining lip 6, and in particular the front element 7, to partially cover over the top edge of match book 3 to hold the match book in place in enclosure 2. The manner in which the front element 7 extends downwardly and inwardly toward back panel 5 acts to exert a restraining compressive force on the top portion of the match book 3. Enclosure 2 and other elements can be sized to accommodate a single elongated match book (shown), a single "standard" size match book (not shown) or two "standard" match books positioned side by side (shown by dotted line in FIG. 1).

Bottom retaining lip 9 is constructed from a flat generally rectangular bottom element 11 which is joined to the bottom edge 19 of back panel 5. Bottom element 11 extends outwardly generally perpendicular to back panel 5. Attached to the front edge of bottom element 11 is a front element 10 which is generally flat and rectangular and extends upwardly from bottom element 11 and outwardly away from back panel 5. It is the purpose of bottom retaining lip 9 to partially wrap around the bottom portion of match book 3 when it is inserted in enclosure 2 to exert a compressive force on the match book to hold it in place within the enclosure. Front elements 7 and 10 of retaining lips 6 and 9 are intended to cover only a portion of the total height of the enclosure 2 thus leaving an opening 12 through which advertisement or other printed matter carried on the front cover of the match book 3 can be viewed while the match book is retained in the holder 1. In addition front element 10 of bottom retaining lip 9 is sized so as to allow the cover of match book 3 to be closed by tucking it beneath front element 10 or into a portion of match book 3.

One of the principal purposes of match book holder 1 is to retain a match book 3 within enclosure 2 in a forceful manner which reduces the likelihood that a child will remove the match book from match book holder 1 while matches still remain in the match book. The Applicant has found that the use of top retaining lip 6 and bottom retaining lip 9 makes it very difficult for a child to remove a full or partially full book of matches through the opening 12 between the two lips. This purpose is partially achieved because top element 8 extends outwardly from back panel 5 a length which is approximately equal to or slightly less than the thickness of the top portion of match book 3. Similarly, bottom element extends outwardly from back panel 5 a length equal to or slightly less than the thickness of the bottom edge of match book 3. Generally, top element 8 will extend outwardly farther than bottom element 11 due to the typical shape of a comb-type book of matches. To restrict the lateral movement of a book of matches which may be positioned beneath the retaining lips 6 and 9, side panels 15 and 20 are provided. Side panel 15 is attached to one edge of back panel 5 and has a generally triangular shape. In the preferred embodiment, side panel 15 extends generally from top element 8 to bottom element 11. The front edge 16 of side panel 15 is generally coincide with a line drawn through front element 7 and front element 10 of the retaining lips. In this manner, side panel 15 almost completely encloses the one end of enclosure 2 and prevents the removal of match book 3 via that end.

It is the purpose of the second side panel 20 to only partially enclose the side opening 24 of enclosure 2. As is shown in detail in FIG. 1, side panel 20 is generally flat and has a back edge 26 which is attached to the side edge of back panel 5 opposite side panel 15. Side panel 20 is bounded by a top edge 22 which extends outwardly from back panel 5 at a location removed from top element 8. Similarly, bottom edge 23 of side panel 20 extends outwardly from back panel 5 at a position removed from by front element 11. The front edge 21 of side panel 20 is generally parallel to back panel 5 and extends outwardly from back panel 5 a distance of approximately 20% of the distance between back panel 5 and front element 7. By limiting the size of side panel 20, the applicant has found that it is possible to forcibly insert match book 3 into enclosure 2 by moving it laterally through the end of enclosure 2 adjacent side panel 20. Once match book 3 is in place in enclosure 2, the applicant has found that it is very difficult to remove the match book by sliding it either through opening 12 or past side panel 20. When the matches have been removed from match book 3, it is relatively easy to remove match book 3 from enclosure 2. For these reasons, it is very difficult for a child to remove a book of matches from enclosure 2 while matches remain in the booklet. This reduces the likelihood that the match book would be removed from the protective match book holder 1 by a child.

In addition to providing means for restricting the removal of match book 3 from match book holder 1, shielding apparatus 4 is provided to protect a strike plate 13, which is attached to match book 3. In the preferred embodiment, match book holder 1 is intended to be used in conjunction with a match book 3 which has a roughened strike plate surface 13 on the back panel of the match book (see FIG. 6). To provide access to strike plate 13, back panel 5 contains a strike window 25. When match book 3 is inserted within enclosure 2, it is intended that the strike plate 13 be indexed with strike window 25. In the preferred embodiment, strike window 25 is generally rectangular and positioned near the bottom edge of back panel 5. To prevent children from striking matches on the strike plate 13, a guard plate 30 is provided which can be slidably moved from a closed position wherein strike window 25 is shielded to an open position wherein the strike window 25 is open. A spring loaded biasing mechanism is provided for maintaining guard plate 30 in its closed position, as will be described in detail later.

Guard plate 30 consists of a generally rectangular cover element 31 which covers the strike window 25 when it is in its closed position. Attached to cover element 31 is an attachment element 32 which extends upwardly along the inside of back panel 5. Guard plate 30 is moved up and down by means of a grip element 34. As is shown in detail in FIGS. 2, 4 and 9 grip element 34 is positioned on the back surface of back panel 5 generally opposite attachment element 32. A slide opening 39 is located generally in the center portion of back panel 5 and has a bottom edge 76. Slide opening 39 is elongated vertically to allow grip element 34 to be moved vertically a sufficient height to remove the cover element 31 from strike window 25. Grip element 34 is attached to element 32 by means of retaining device 70. As is shown in detail in FIG. 5, retaining device 70 is comprised of a base element 71 which extends outwardly from attachment element 32, and a retaining dowel 72 which protrudes upwardly from top surface 73 of base element 71. It is the purpose of retaining device 70 to be insertible in a retaining recess 42 located in grip element 34. Referring to FIG. 9, retaining recess 42 is a slot cut in the back side of grip element 34 at the bottom of spring recess 44. Base element 71 extends through slide opening 39 and is positionable within retaining recess 42. This structure allows grip element 34 to be easily and securely attached to attachment element 32 to allow cover element 31 to move in response to movement of grip element 34.

To forcibly bias guard plate 30 in its closed position so that strike plate 13 is covered and cannot be utilized by children, a biasing spring 33 is attached between back panel 5 and attachment element 32 of guard plate 30. To accommodate biasing spring 33, spring 33 is inserted over retaining dowel 72 and abuts surface 73. This holds spring 33 securely in place. Spring recess 44, having a semi-circular cross section and extending vertically, is provided in grip element 34 and is intended to be indexed with a spring recess 29 in back panel 5. Thus, one end of biasing spring 33 rests against surface 73 which is positioned in retaining recess 42 of grip element 34. When biasing spring 33 is at its extended or biased length, it exerts force upon guard plate 30 to force it into its closed position.

Spring recess 29 is formed in back panel 5 by deforming the surface of back panel 5 to form a semi-circular trough. Other means of providing spring recess 29 may also be utilized. Spring recess 29 has a generally semi-circular cross section and is intended to accommodate the upper portion of biasing spring 33. An opening 37 in back panel 5 allows biasing spring 33 to be inserted into spring recess 29. A top surface 38 in spring recess 29 provides a back stop for biasing spring 33 which allows it to exert force on guard plate 30 and urge it into its closed position. To restrict the downward movement of grip element 34 in response to the force of spring 33, a stop element 36 protrudes outwardly from the surface of grip element 34 which abuts back panel 5. It is the purpose of stop element 36 to abut against bottom edge 76 of slide opening 39 to restrict downward movement.

While the biasing force of spring 33 is intended to exert sufficient force on guard element 30 to prevent a child with relatively weak finger strength from moving guard element 30 and exposing the strike plate 13, the release tab 50 is also provided to lock guard element 30 in its closed position. Referring to FIG. 4, release tab 50 consists of a locking member 51 which is attached to back panel 5 by means of a connecting strip 53. Locking member 51 and connecting strip 53 form a resilient member which in its biased position lies generally parallel with back surface 50. In this biased position, locking member 51 extends outwardly from the outer surface of back panel 5 and is positioned generally above the top surface of grip element 34 (see FIG. 2). In the preferred embodiment, locking member 51 and connecting strip 53 are formed by partially cutting out a portion of back panel 5 forming an opening 54 in which locking member 51 is positioned. A release button 52 is attached to locking member 51 such that when release button 52 is depressed inwardly toward match book 3, locking member 51 is moved out of alignment with grip element 34 thereby allowing grip element 34 to be moved upwardly. When a match book 3 is retained in enclosure 2, the flexible cover of the match book resists the inwardly movement of locking member 51 thereby requiring a stronger pressure on release button 52 in order for locking member 51 to be moved out of alignment with grip element 34. Thus, for a person to fully release shielding apparatus 4, he must first depress the release button 52 and then move grip element 34 with sufficient finger or thumb force to overcome the biasing force of spring 33. By performing this sequence of steps, the guard element 30 is removed from opening 25 thereby exposing the strike plate 13. Applicant has found that it is very difficult if not impossible for a mere child to perform these various steps in proper sequence thereby making it highly unlikely that a child could properly manipulate shielding apparatus 4 to expose the strike plate 13. This feature of the match book holder 1, in combination with the design of enclosure 2 which makes it very difficult for a child to remove the entire match book 3 from the enclosure provides a match book holder 1 which greatly reduces the likelihood that the matches which are contained within it will be removed or utilized by a child.

As is shown is FIGS. 7 and 8, a second embodiment of the present invention may incorporate a strike surface 63 which is attached to the back panel 5 of enclosure 2. Fixed strike plate 63 in effect replaces the function of strike plate 13 which is carried on match book 3. To allow guard element 30 to cover strike surface 63, the strike surface is carried on a strike member 62. In this embodiment, strike member 62 is a generally flat rectangular element positioned parallel to back panel 5 and supported adjacent to back panel 5 by means of side support elements 64. As is shown in FIG. 7, support elements 64 are generally perpendicular to back panel 5 and extend inwardly toward front element 10. This positioning of strike member 62 provides an open space 65 into which guard plate 30 can be slidably moved and was described in detail earlier. Thus, a strike surface 63 is always present on the match book holder 1, yet is shielded from use by means of shielding apparatus 4 which helps prevent its use by a child. In this embodiment, it is not necessary that the match book 3 carry its own strike plate although it may. Strike surface 63 may be permanently affixed to strike member 62 (not shown) or it may be removably attached to strike member 62 by means of an adhesive surface 66 on the back side of strike surface 63. As is shown in detail in FIG. 8, strike surface 63 could incorporate an adhesive surface 66 which is covered by an inert covering 67 until it is intended that it be attached to strike member 62. In this manner, as strike surface 63 is depleted it may be replaced by a new strike surface.

The operation of the preferred embodiment of match book holder 1 can be summarized as follows. A match book 3 is inserted into enclosure 2 and beneath each of retaining lips 6 and 9 by forcing one edge of the match book past side panel 20 which partially encloses one end of enclosure 2. Once the match book 3 has been inserted in enclosure 2, the front cover of the match book is exposed to show advertising carried thereon and can be easily opened and closed to expose the matches contained within the match book. After the match book 3 has been inserted in enclosure 2, the structure of enclosure 2 makes it difficult for a child to remove the full or partially full match book from the enclosure. After the matches have been removed from the match book, it is relatively easy to remove the match book from enclosure 2 by merely gripping the front cover of the empty book of matches and with a slight pull straight forward through opening number 12 the empty match book will come out easily. When matches are still in the match book this method will not work since it is the matches themselves that keep the match book in the holder. When you pull straight forward on a full or partially full book of matches it is elements number 7 and number 10 that hold the book of matches on top and bottom and element number 5 prevents the matches from bending and coming out through opening number 12.

In order for the intended adult user of the match book holder 1 to ignite a match on strike plate 13, or on strike surface 63 attached to back panel 5, guard plate 30 is moved upwardly by first depressing release button 52 and by then exerting thumb or finger pressure on grip element 34 to move it upwardly. This upward motion moves guard plate 30 from its biased position wherein a cover strike window 25 to its open position wherein strike plate 30 or strike surface 63 is exposed for use. After the match has been struck, grip element 34 and release button 52 are released and biasing spring 33 forces guard element 32 into its closed position.

What is claimed is:

1. A holder for a book of matches of the type having a strike plate on the back panel, the holder being intended to prevent the removal of the match book from the holder or the striking by children of matches removed from the holder, and comprising:

a. an enclosure element for retaining a match book, said enclosure having a back panel, a top retention lip and a bottom retention lip; said top retention lip extending outwardly from the top edge of said back panel and thence downwardly toward said bottom retention lip, said bottom retention lip extending outwardly from the bottom edge of said back panel and thence upwardly toward said top retention lip, said two retention lips forcibly restraining a book of matches which may be inserted therebetween with a portion of the match book cover surface exposed to display advertising carried thereon and to allow the match book cover to be opened for match removal;

b. a first side panel connected to one end of said enclosure, said first side panel generally extending outwardly from said back panel between said top and bottom retention lips to restrict lateral movement of a book of matches which may be positioned beneath said retention lips;

c. a second side panel connected to a second end of said enclosure opposite said first side panel and generally extending outwardly from said back panel, said second side panel only partially enclosing the open end space bounded by said retention lips and said back panel to restrict free lateral movement of a generally full book of matches through said opening while allowing a book of matches to be forcibly inserted beneath said top and bottom retention lips by partial compression of the match book;

d. said back panel having a strike plate opening therein intended to be indexed with the strike plate carried by a book of matches which may be positioned in said enclosure;

e. finger-actuated shielding means for selectively covering said strike plate opening, said shielding means including a guard element which is movable from a closed position wherein it covers said opening to an open position wherein it is removed from said opening to expose the strike plate of a match book which may be positioned within said enclosure allowing a match to be struck thereon; and f. biasing means for forcibly biasing said guard element into its closed position to resist movement of said guard element from the closed position by the finger motion of a child.

2. The match book holder of claim 1 wherein said biasing means include a spring operably attached between said enclosure and said guard element, said spring compressible from a normal extended length to a contracted length wherein it exerts an axial force to bias said guard element into its closed position.

3. The match book holder of claim 1 wherein said shielding means include a grip element attached to said guard element and protruding through said enclosure back panel, said guard element movable from its biased closed position to its open position by finger force exerted upon said grip element;

4. The match book holder of claim 1 and further including a release mechanism for restricting movement of said guard element from its biased to its open position, said release mechanism comprising:

a. a locking member positioned adjacent said back panel and movable from a biased locking position to an unlocked position, said locking member protruding outwardly from said back panel and adjacent said grip element to prevent sliding movement of said grip element when said locking member is in its biased locked position, said locking member movable to an unlocked positioned wherein it is positioned within the outer surface of said back panel so as not to restrict movement of said grip element and;

b. release means attached to said locking member for moving said locking member from said biased locked position to said unlocked position in response to thumb or finger motion.

5. The match book holder of claim 1, including:

a. a strike plate attached to said back panel and generally indexed with said strike opening;

b. means for attaching said strike plate adjacent said strike opening and spaced apart inwardly from said back panel to allow said guard element to move between said strike plate and said strike opening as said guard element is moved from its biased closed to its open position; and c. a strike surface carried by said strike plate, said strike surface indexed with said strike opening such that it is exposed through said strike opening when said guard element is in its open position and wherein said strike surface is covered by said guard element when said guard element is in its biased closed position.

* * * * *